US009676398B2

(12) United States Patent
Hirashima et al.

(10) Patent No.: US 9,676,398 B2
(45) Date of Patent: Jun. 13, 2017

(54) SIDE ENTRANCE AND RAILCAR INCLUDING SAME

(71) Applicant: KAWASAKI JUKOGYO KABUSHIKI KAISHA, Kobe-shi, Hyogo (JP)

(72) Inventors: Toshiyuki Hirashima, Kobe (JP); Shirou Honma, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 0 days.

(21) Appl. No.: 14/916,434

(22) PCT Filed: Sep. 19, 2013

(86) PCT No.: PCT/JP2013/005535

§ 371 (c)(1),
(2) Date: Mar. 3, 2016

(87) PCT Pub. No.: WO2015/040653

PCT Pub. Date: Mar. 26, 2015

(65) Prior Publication Data

US 2016/0221589 A1 Aug. 4, 2016

(51) Int. Cl.

| | |
|---|---|
| ***B61D 19/02*** | (2006.01) |
| ***B61D 23/00*** | (2006.01) |
| ***B61D 1/00*** | (2006.01) |

(52) U.S. Cl.

CPC ..... *B61D 19/02* (2013.01); *B61D 1/00* (2013.01); *B61D 23/00* (2013.01)

(58) Field of Classification Search

CPC ..... B61D 23/00; B61D 23/02; B61D 23/025; B61D 19/02

See application file for complete search history.

(56) References Cited

U.S. PATENT DOCUMENTS 3,724,396 A * 4/1973 Roth ..... B61D 23/02 105/378
3,795,205 A 3/1974 Gritchen et al.
(Continued)

FOREIGN PATENT DOCUMENTS

FR 2609266 A1 7/1988
GB 648643 A 1/1951
(Continued)

OTHER PUBLICATIONS

Nov. 12, 2013 International Search Report issued in International Patent Application No. PCT/JP2013/005535.
(Continued)

*Primary Examiner* — Zachary Kuhfuss
(74) *Attorney, Agent, or Firm* — Oliff PLC

(57) ABSTRACT

A side entrance includes a step, a door frame, a door leaf, and a door pocket. A vertical frame included in the door frame and located close to a bogie includes: an upper vertical frame portion located above a floor surface; and a lower vertical frame portion located under the floor surface. The lower vertical frame portion is located closer to an inner side of the door frame than the upper vertical frame portion. A width of an upper step portion of the step in a car longitudinal direction is larger than a width of a lower step portion of the step in the car longitudinal direction.

5 Claims, 3 Drawing Sheets

(56) References Cited

U.S. PATENT DOCUMENTS

| | | | | |
|---|---|---|---|---|
| 3,924,545 | A * | 12/1975 | Anders | B61D 23/00 105/429 |
| 4,583,466 | A | 4/1986 | Reddy et al. | |
| 5,165,839 | A | 11/1992 | Aoki | |
| 5,224,723 | A | 7/1993 | Hatas | |
| 5,230,288 | A | 7/1993 | Bickel | |
| 6,357,362 | B1 | 3/2002 | Krbec et al. | |
| 6,495,933 | B2 | 12/2002 | Tokuda et al. | |
| 2010/0043669 | A1 | 2/2010 | Hachet et al. | |
| 2015/0083023 | A1* | 3/2015 | Hirashima | B61D 23/025 105/447 |

FOREIGN PATENT DOCUMENTS

| | | | |
|---|---|---|---|
| JP | S49-58511 | A | 6/1974 |
| JP | 2001-158346 | A | 6/2001 |

OTHER PUBLICATIONS

Nov. 12, 2013 Written Opinion of the International Searching Authority issued in International Patent Application No. PCT/JP2013/005535.

* cited by examiner

SIDE ENTRANCE AND RAILCAR INCLUDING SAME

TECHNICAL FIELD

The present on relates to a side entrance provided at a side panel portion of a railcar.

BACKGROUND ART

In some cases, a step is provided at a side entrance of a railcar traveling on a route including stations of high platforms and stations of low platforms (see PTL 1). The step is formed so as to extend downward from a floor surface of a car interior. When the platform is low, passengers get on and off the railcar by using the step. When the platform is high, the passengers get on and off the railcar without using the step. A door leaf configured to open and close the side entrance largely protrudes downward from an underframe (floor surface) of a carbody so as to cover the step. Therefore, a lower portion of the door pocket accommodating the door leaf also largely protrudes downward from the underframe of the carbody.

CITATION LIST

Patent Literature

PTL 1: U.S. Pat. No. 6,495,933

SUMMARY OF INVENTION

Technical Problem

When the side entrance including the step is provided near a bogie, and the railcar enters a curved track and the bogie turns, the bogie and the door pocket may interfere with each other. To avoid such interference, an effective opening width of the side entrance may be reduced. According to this configuration, a width of the door leaf can be reduced, and therefore, a width of the door pocket can be reduced. As a result, the interference between the bogie and the door pocket can be avoided. On the other hand, to allow a passenger in a wheelchair to easily get on and off the railcar, the side entrance needs to have a certain effective opening width or more.

The present invention was made in consideration of these circumstances, and an object of the present invention is to provide a side entrance which prevents a bogie and a door pocket from interfering with each other and allows a passenger in a wheelchair to get on and off a railcar.

Solution to Problem

A side entrance according to one aspect of the present invention is a side entrance of a railcar, the side entrance being provided near a bogie, the side entrance including: a step extending downward from a floor surface of a car interior; a door frame including a lower end, the lower end reaching a lower step portion of the step; a door leaf having a shape corresponding to a shape of the door frame and configured to slide in a car longitudinal direction; and a door pocket located at the bogie side with respect to the door frame and configured to accommodate the door leaf, a vertical frame being included in the door frame and located close to the bogie, the vertical frame including an upper vertical frame portion located above the floor surface and a lower vertical frame portion located under the floor surface, the lower vertical frame portion being located closer to an inner side of the door frame than the upper vertical frame portion, a width of an upper step portion of the step in the car longitudinal direction is larger than a width of a lower step portion of the step in the car longitudinal direction.

According to this side entrance, a width of a lower portion of the door leaf can be reduced. With this, a width of a lower portion of the door pocket can also be reduced, and as a result, interference between the bogie and the door pocket can be avoided. Further, according to the above configuration, a certain effective opening width or more of a portion included in the side entrance and located above the floor surface can be secured. Therefore, a passenger in a wheelchair can get on and off the railcar through an upper portion of the side entrance. On the other hand, an effective opening width of a lower portion of the side entrance is small. However, the passenger in the wheelchair does not usually use the step. Therefore, the small effective opening width of the portion corresponding to the step does not influence on getting on and off of the passenger in the wheelchair.

Advantageous Effects of Invention

As above, the above side entrance prevents the bogie and the door pocket from interfering with each other and allows the passenger in the wheelchair to get on and off the railcar.

DESCRIPTION OF EMBODIMENTS

Hereinafter, one embodiment of the present invention will be explained in reference to the drawings. In the following description and the drawings, the same reference signs are used for the same or corresponding components, and a repetition of the same explanation is avoided.

Configuration of Railcar

Figure 1:
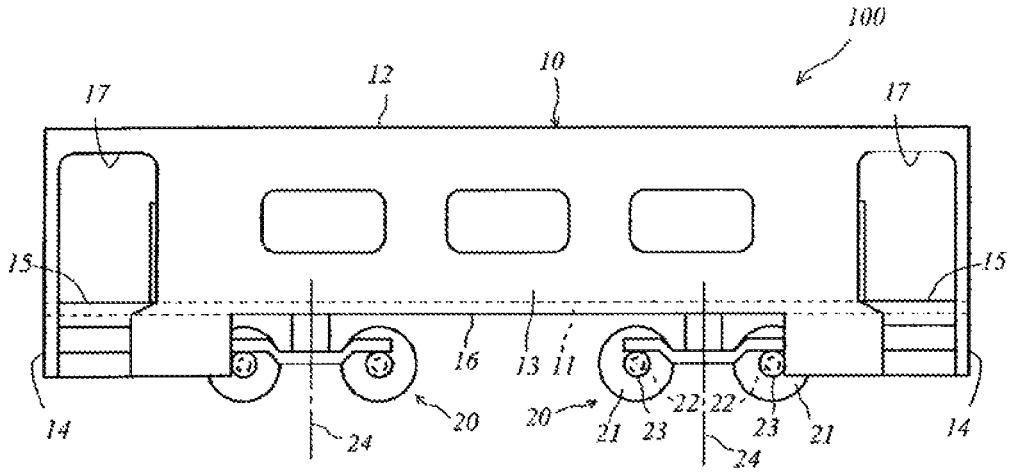
FIG. 1 is a schematic side view of a railcar according to the present embodiment.

First, the configuration of a railcar 100 will be explained. FIG. 1 is a side view of the railcar 100. A leftward/rightward direction on a paper surface of FIG. 1 corresponds to a car longitudinal direction, and a direction orthogonal to the paper surface corresponds to a car width direction. FIG. 1 shows a state where a side entrance 17 is opened. As shown in FIG. 1, the railcar 100 is mainly constituted by a carbody 10 and bogies 20.

The carbody 10 includes: an underframe 11 constituting a floor portion; a roof bodyshell 12 constituting a roof; a pair of left and right side bodyshells 13 constituting side panel portions; and a pair of front and rear end bodyshells 14 constituting end panel portions (car longitudinal direction end portions). The underframe 11 is formed by a plurality of beam members and has a predetermined thickness. Therefore, there is a certain difference between a height position of a floor surface 15 of a car interior and a height position of a lower surface 16 of the underframe 11. The side entrance 17 is provided at the side panel portion (side bodyshell 13) of the carbody. The side entrance 17 is provided near the bogie 20 and located between the end panel portion (end bodyshell 14) and the bogie 20 in the car longitudinal direction. Details of the side entrance 17 will be described later.

The bogie 20 supports the carbody 10 from the lower surface 16 side of the underframe 11. One railcar 100 includes two bogies 20, and each of the bogies 20 includes four wheels 21. Two wheels 21 as a pair are coupled to each other through an axle 22, and both end portions of the axle 22 are supported by respective bearings 23 each located at an outer side of the wheel 21 in the car width direction. When the railcar 100 enters a curved track, the bogie 20 turns relative to the carbody 10 around a rotation axis 24 extending in a vertical direction through a center of the bogie 20. A rotation angle of the bogie 20 may become about 8 degrees at most depending on curvature of the track.

Configuration of Side Entrance

Figure 2:
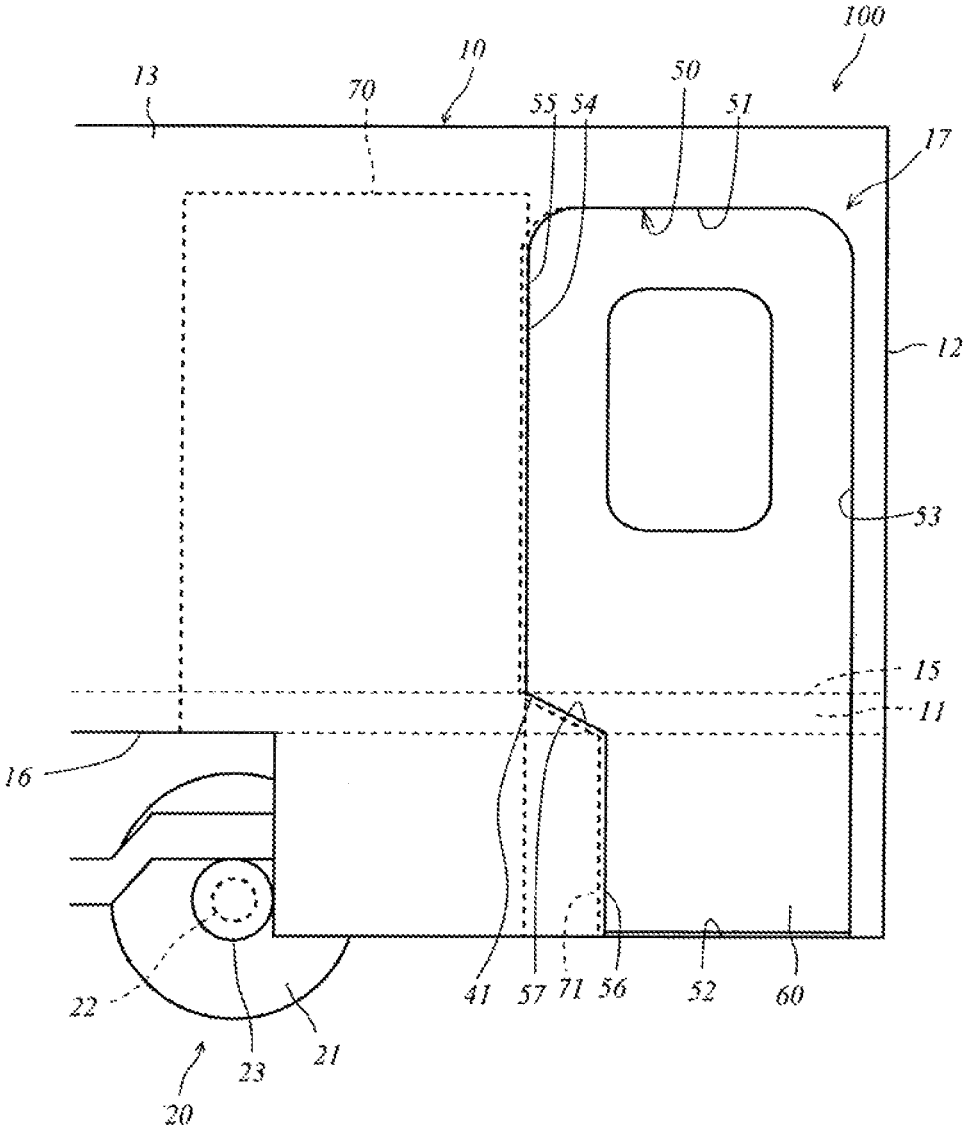
FIG. 2 is an enlarged view showing the vicinity of a side entrance and is a diagram showing a state where the side entrance is closed.
Figure 3:
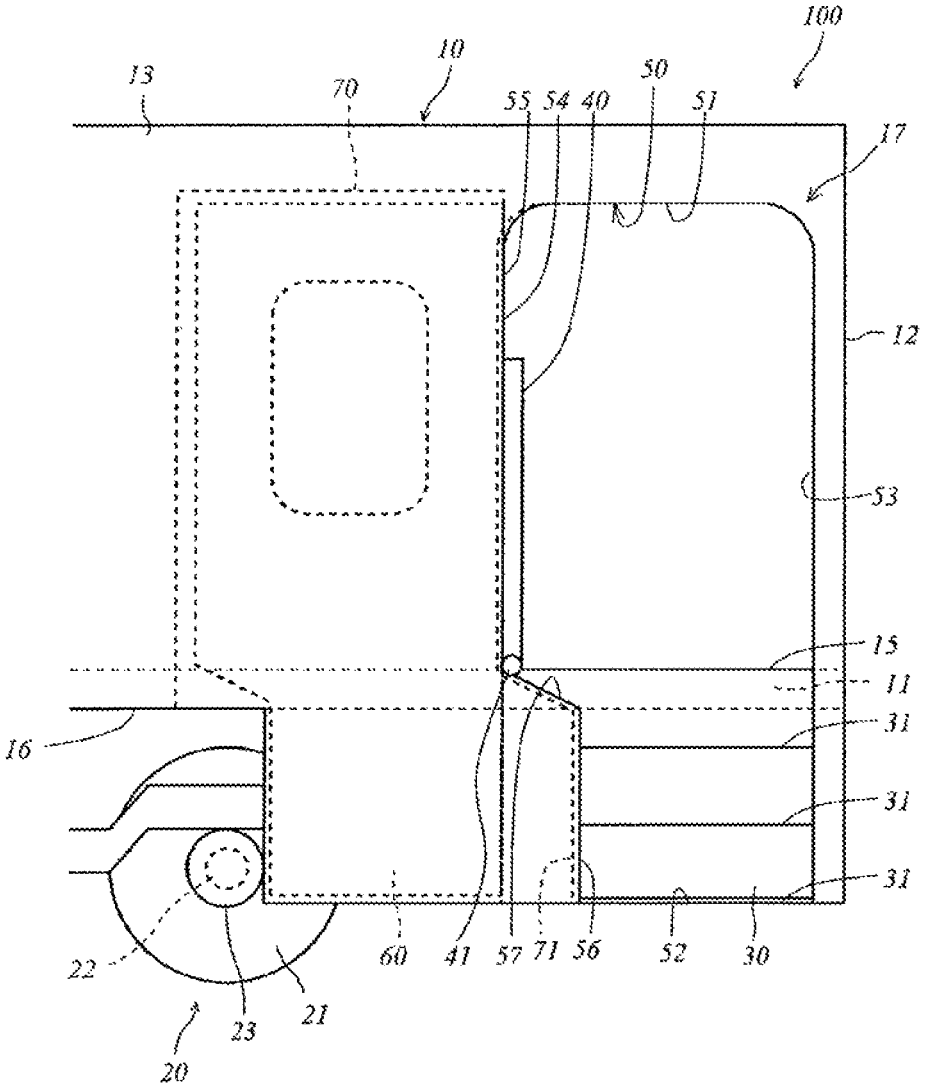
FIG. 3 is an enlarged view showing the vicinity of the side entrance and is a diagram showing a state where the side entrance is opened.

Next, the configuration of the side entrance 17 will be explained. FIGS. 2 and 3 are enlarged views each showing the vicinity of the side entrance 17 shown in FIG. 1. FIG. 2 shows a state where the side entrance 17 is closed. FIG. 3 shows a state where the side entrance 17 is opened. As shown in FIGS. 2 and 3, the side entrance 17 includes a step 30, a trap door (cover plate) 40, a door frame 50, a door leaf 60, and a door pocket 70.

The step 30 extends downward from the floor surface 15 of the car interior. When a platform is low, passengers get on and off the railcar by using the step 30. The step 30 of the present embodiment includes three footboards 31. Hereinafter, an upper portion including the uppermost footboard 31 is referred to as an "upper step portion", and a lower portion including the lowermost footboard 31 is referred to as a "lower step portion". As shown in FIG. 3, a width of the upper step portion of the step 30 in the car longitudinal direction decreases as the upper step portion of the step 30 extends downward from the floor surface 15, and when the width of the upper step portion of the step 30 becomes a predetermined width, the width of the upper step portion of the step 30 becomes constant therefrom. To be specific, the width of the upper step portion of the step 30 in the car longitudinal direction is lamer than a width of the lower step portion of the step 30 in the car longitudinal direction.

When the platform is high, passengers get on and off the railcar by using the trap door 40. The trap door 40 bridges a space between the platform and the floor surface 15 of the side entrance 17. In the present embodiment, the trap door 40 includes a rotating shaft member 41 extending in the car width direction. When the step 30 is not used, the trap door 40 rotates to cover the step 30. When the trap door 40 covers the step 30, an upper surface of the trap door 40 and the floor surface 15 are flush with each other. FIG. 3 shows a state where the step 30 is not covered with the trap door 40. The trap door 40 may be rotated by an operation in a driver's cab or by an operation of a crew, a passenger, or the like. The trap door 40 may move in a horizontal direction in a horizontal state to cover the step 30.

The door frame 50 forms an opening portion of the side entrance 17. The door frame 50 includes: an upper frame 51 located at an upper portion and extending in the car longitudinal direction; a lower frame 52 located at a lower portion and extending in the car longitudinal direction; and a pair of vertical frames 53 and 54 located at respective side portions in the car longitudinal direction and extending in an upward/downward direction. The lower frame 52 is located at the lower step portion of the step 30. To be specific, a lower end of the door frame 50 reaches the lower step portion of the step 30.

The vertical frame 53 located farther from the bogie 20 among the vertical frames 53 and 54 is formed linearly. On the other hand, the vertical frame 54 located close to the bogie 20 is bent. The vertical frame 54 located close to the bogie 20 includes: an upper vertical frame portion 55 located above the floor surface 15 of the car interior; a lower vertical frame portion 56 located under the floor surface 15; and a middle vertical frame portion 57 located between the upper vertical frame portion 55 and the lower vertical frame portion 56 and connecting the vertical frame portions 55 and 56 with each other. The upper vertical frame portion 55 and the lower vertical frame portion 56 extend linearly in the vertical direction. The middle vertical frame portion 57 is inclined such that a lower end of the middle vertical frame portion 57 is located closer to an inner side of the door frame 50 than an upper end of the middle vertical frame portion 57. The middle vertical frame portion 57 is not horizontal but is inclined relative to a horizontal plane, which is because this is advantageous to prevent air from flowing into the railcar from outside (i.e., to stop the air) as described below.

The lower vertical, frame portion 56 is located closer to the inner side of the door frame 50 than the upper vertical frame portion 55. With this, the effective opening width of a portion included in the side entrance 17 and located above the floor surface 15 (i.e., a portion corresponding to the upper vertical frame portion 55) is larger than the effective opening width of a portion included in the side entrance 17 and located under the lower surface 16 of the underframe 11 (i.e., a portion corresponding to the lower vertical frame portion 56). In the present embodiment, to allow the wheelchair to pass through the side entrance 17, the effective opening width of the portion included in the side entrance 17 and located above the floor surface 15 is set to not less than 34 inches (about 86 centimeters). On the other hand, the effective opening width of the portion included in the side entrance 17 and located under the lower surface 16 of the underframe 11 is set to be small such that passengers can walk through the side entrance 17.

The upper end (a boundary between the middle vertical frame portion 57 and the upper vertical frame portion 55) of the middle vertical frame portion 57 is the same in height as the floor surface 15 of the car interior. The lower end (a boundary between the middle vertical frame portion 57 and the lower vertical frame portion 56) of the middle vertical frame portion 57 is the same in height as the lower surface 16 of the underframe 11. To be specific, the effective opening width of the side entrance 17 varies between the floor surface 15 of the car interior and the lower surface of the underframe 11. With this, while securing the large effective opening width at the position above the floor surface 15, the effective opening width can be made small at the position lower than the lower surface 16 of the underframe 11.

The door leaf 60 slides in the car longitudinal direction to open and close the opening portion of the side entrance 17. Therefore, the door leaf 60 has a shape corresponding to a shape of the door frame 50. Specifically, an upper end of the door leaf 60 is located at a position corresponding to the upper frame of the door frame 50, and a lower end of the door leaf 60 is located at a position corresponding to the lower frame of the door frame 50. To be specific, a lower portion of the door leaf 60 projects to a lower side of the lower surface 16 of the underframe 11. A car longitudinal direction width of an upper portion included in the door leaf 60 and located above the floor surface 15 of the car interior is larger than a car longitudinal direction width of a lower portion included in the door leaf 60 and located under the lower surface of the underframe 11. A side included in the door leaf 60 and located close to the bogie 20 is bent so as to correspond to a shape of the vertical frame 54 included in the door frame 50 and located close to the bogie 20. Further, a portion included in the door leaf 60 and corresponding to the lower vertical frame portion 56 of the door frame 50 is located closer to an inner side of the door leaf 60 than a portion included in the door leaf 60 and corresponding to the upper vertical frame portion 55 of the door frame 50. Since the door leaf 60 has a shape corresponding to the shape of the door frame 50, wind, rain, and the like are prevented from entering into the car interior.

The door pocket 70 accommodates the door leaf 60. The door pocket 70 of the present embodiment is located at the bogie 20 side with respect to the door frame 50. Since the door pocket 70 accommodates the door leaf 60, the door pocket 70 has a shape corresponding to the shape of the door leaf 60, and therefore, the shape of the door frame 50. On this account, a lower portion included in the door pocket 70 and located under the lower surface of the underframe 11 projects to a lower side of the lower surface 16 of the underframe 11. A width of the lower portion of the door pocket 70 in the car longitudinal direction is small, and a portion included in the door pocket 70 and corresponding to the lower portion of the door leaf 60 is located closer to the door frame 50 than a portion included in the door pocket 70 and corresponding to the upper portion of the door leaf 60. Therefore, the interference between the door pocket 70 and the bogie 20 can be avoided.

A band-shaped sealing member 71 is attached to an entrance portion of the door pocket 70 (i.e., to the vertical frame 54 included, in the door frame 50 and located close to the bogie 20). The sealing member 71 closes a gap between the door pocket 70 and the door leaf 60 to prevent air from entering into the car interior through the door pocket 70 from outside. The sealing member 71 is attached to the door pocket 70 (in a standing state) so as to bridge a space between a tip end of the door pocket 70 and an end portion included in the door leaf 60 and located close to the bogie. With this configuration, when the door leaf 60 is in a closed state, the space between the door pocket 70 and the door leaf 60 is sealed. Therefore, if an angle of the sealing member 71 relative to a slide direction horizontal direction) of the door leaf 60 is small, contact force of the sealing member 71 becomes inadequate, so that the sealing member 71 cannot adequately achieve a sealing function. In the present embodiment, as described above, the middle vertical frame portion 57 of the door frame 50 is inclined relative to the horizontal direction. With this, the sealing member 71 attached to a portion included in the door pocket 70 and corresponding to the middle vertical frame portion 57 can adequately achieve the sealing function. To achieve the sealing function, it is desirable that the angle of the middle vertical frame portion 57 relative to the horizontal direction be not less than 30 degrees, and it is more desirable that the angle be not less than 45 degrees.

The foregoing has explained the configuration of the side entrance 17 according to the present embodiment. The foregoing has explained a case where the lower end of the middle vertical frame portion 57 and the lower surface 16 of the uuderframe 11 are the same in height as each other. However, the side entrance 17 does not have to be configured as above. For example, since the bearing 23 of the bogie 20 relatively tends to interfere with the door pocket 70, the lower end of the middle vertical frame portion 57 may be just required to be located above the bearing 23 of the bogie 20 (i.e., above the axle 22). Even in such a case, since the car longitudinal direction width of a portion included in the door pocket 70 and having a height equal to a height of the bearing 23 becomes small, the bogie 20 and the door pocket 70 hardly interfere with each other.

The present embodiment assumes a case Where the passenger in the wheelchair gets on or off the railcar from or to the high platform and a case where the passenger in the wheelchair gets on or off from or to the low platform provided with a lifting device for wheelchairs. It should be noted that the side entrance 17 may be provided with a wheelchair lift device such that the passenger in the wheelchair can get on or off the railcar from or to the low platform which is not provided with the filling device. If the lift device provided at the side entrance 17 can lift up the wheelchair from the low platform to the floor surface 15, the passenger in the wheelchair can get on or off the railcar from or to any platform.

Effects, etc.

As above, the side entrance 17 according to the present embodiment is the side entrance 17 included in the railcar 100 and provided near the bogie 20, and includes: the step 30 extending downward from the floor surface 15 of the car interior; the door frame 50 including the lower end, the lower end reaching the lower step portion of the step 30; the door leaf 60 having the shape corresponding to the shape of the door frame 50 and configured to slide in the car longitudinal direction; and the door pocket 70 located at the bogie 20 side with respect to the door frame 50 and configured to accommodate the door leaf 60. The vertical frame 54 included in the door frame 50 and located close to the bogie 20 includes the upper vertical frame portion 55 located above the floor surface 15 and the lower vertical frame portion 56 located under the floor surface 15, and the lower vertical frame portion 56 is located closer to the inner side of the door frame 50 than the upper vertical frame portion 55. The width of the upper step portion of the step 30 in the car longitudinal direction is larger than the width of the lower step portion of the step 30 in the car longitudinal direction.

Since the side entrance 17 according to the present embodiment is configured as above, the width of the lower portion of the door leaf 60 can be reduced. With this, the width of the lower portion of the door pocket 70 can also be reduced, and as a result, the interference between the underframe 11 and the door pocket 70 can be avoided. Further, according to the present embodiment, a certain effective opening width or more of the portion included in the side entrance 17 and located above the floor surface 15 can be secured. Therefore, the passenger in the wheelchair can get on and off the railcar through the upper portion of the side entrance 17. On the other hand, the effective opening width of the lower portion of the side entrance 17 is small. However, the passenger in the wheelchair does not usually use the step 30. Therefore, the small effective opening width of the portion corresponding to the step 30 does not influence on getting on and off of the passenger in the wheelchair.

In the present embodiment, the vertical frame 53 included in the door frame 50 and located far from the bogie 20 is formed linearly. Therefore, the effective opening width of the side entrance 17 can be adequately secured, and the door frame 50 can be easily worked.

In the present embodiment, the vertical frame 54 included in the door frame 50 and located close to the bogie 20 further includes the middle vertical frame portion 57 located between the upper vertical frame portion 55 and the lower vertical frame portion 56. The middle vertical frame portion 57 is inclined at a predetermined angle relative to a horizontal plane and connects the upper vertical frame portion 55 with the lower vertical frame portion 56. Therefore, a portion included in the sealing member 71 and attached to the middle vertical frame portion 57 can adequately achieve the sealing function, the sealing member 71 being attached to the entrance portion of the door pocket 70, that is, to the vertical frame 54 of the door frame 50.

It is desirable that: the upper end of the middle vertical frame portion 57 be the same in height as the floor surface 15 in a height direction; and the lower end of the middle vertical frame portion 57 be located between the lower surface 16 of the underframe 11 of the carbody 10 and the axle 22 of the bogie 20 in the height direction. With this configuration, a car longitudinal direction width of a portion included in the door pocket 70 and relatively tending to interfere with the bogie 20 can be reduced. Therefore, while securing the adequate sealing function by the sealing member 71, the interference between the door pocket 70 and the logic 20 can be avoided.

The railcar 100 according to the present embodiment is the railcar 100 including the side entrance 17 provided near the bogie 20, and the side entrance 17 includes: the step 30 extending downward from the floor surface 15 of the car interior; the door frame 50 including the lower end, the lower end reaching the lower step portion of the step 30; the door leaf 60 having the shape corresponding to the shape of the door frame 50 and configured to slide in the car longitudinal direction; and the door pocket 70 located at the bogie 20 side with respect to the door frame 50 and configured to accommodate the door leaf 60. The vertical frame 54 included in the door frame 50 and located close to the bogie 20 includes the upper vertical frame portion 55 located above the floor surface 15 and the lower vertical frame portion 56 located under the floor surface 15, and the lower vertical frame portion 56 is located closer to the inner side of the door frame 50 than the upper vertical frame portion 55. The width of the upper step portion of the step 30 in the car longitudinal direction is larger than the width of the lower step portion of the step 30 in the car longitudinal direction.

Since the railcar 100 according to the present embodiment is configured as above, the interference between the bogie 20 and the door pocket 70 can be avoided. Further, the passenger in the wheelchair can get on and off the railcar through the upper portion of the side entrance 17.

The foregoing has explained the embodiments of the present invention in reference to the drawings. However, specific components are not limited to these embodiments, and design changes and the like within the scope of the present invention are included in the present invention.

INDUSTRIAL APPLICABILITY

The side entrance according to the present invention prevents the underframe and the door pocket from interfering with each other and allows the passenger in the wheelchair to get on and off the railcar. Therefore, the present invention is useful in a technical field of railcars.

REFERENCE SIGNS LIST 10 carbody
11 underframe
15 floor surface
16 lower surface
17 side entrance
20 bogie
21 wheel
22 axle
30 step
50 door frame
53 vertical frame
54 vertical frame
55 upper vertical frame portion
56 lower vertical frame portion
57 middle vertical frame portion
60 door leaf
70 door pocket
100 railcar

The invention claimed is:

1. A side entrance of a railcar, the side entrance being provided near a bogie,
the side entrance comprising:
a step extending downward from a floor surface of a car interior;
a door frame including a lower end, the lower end reaching a lower step portion of the step;
a door leaf having a single unitary body with a shape corresponding to a shape of the door frame and configured to slide in a car longitudinal direction; and
a door pocket located at the bogie side with respect to the door frame and configured to accommodate the door leaf,
a vertical frame being included in the door frame and located close to the bogie, the vertical frame including an upper vertical frame portion located above the floor surface and
a lower vertical frame portion located under the floor surface,
the lower vertical frame portion being located closer to an inner side of the door frame than the upper vertical frame portion,
a width of an upper step portion of the step in the car longitudinal direction is larger than a width of a lower step portion of the step in the car longitudinal direction.

2. The side entrance according to claim 1, wherein a vertical frame included in the door frame and located far from the bogie is formed linearly.

3. The side entrance according to claim 1, wherein:
the vertical frame included in the door frame and located close to the bogie further includes a middle vertical frame portion located between the upper vertical frame portion and the lower vertical frame portion; and
the middle vertical frame portion is inclined at a predetermined angle relative to a horizontal plane and connects the upper vertical frame portion with the lower vertical frame portion.

4. The side entrance according to claim 3, wherein:
an upper end of the middle vertical frame portion is the same in height as the floor surface in a height direction; and
a lower end of the middle vertical frame portion is located between a lower surface of an underframe of the carbody and an axle of the bogie in the height direction.

5. A railcar comprising a side entrance provided near a bogie,
the side entrance comprising:
a step extending downward from a floor surface of a car interior;
a door frame including a lower end, the lower end reaching a lower step portion of the step;
a door leaf having a single unitary body with a shape corresponding to a shape of the door frame and configured to slide in a car longitudinal direction; and a door pocket located at the bogie side with respect to the door frame and configured to accommodate the door leaf, a vertical frame being included in the door frame and located close to the bogie, the vertical frame including an upper vertical frame portion located above the floor surface and a lower vertical frame portion located under the floor surface, the lower vertical frame portion being located closer to an inner side of the door frame than the upper vertical frame portion, a width of an upper step portion of the step in the car longitudinal direction is larger than a width of a lower step portion of the step in the car longitudinal direction.

* * * * *